US011639795B2

(12) United States Patent
Swaby et al.

(10) Patent No.: US 11,639,795 B2
(45) Date of Patent: May 2, 2023

(54) TAPERED FUEL GALLERY FOR A FUEL NOZZLE

(71) Applicant: Pratt & Whitney Canada Corp., Longueuil (CA)

(72) Inventors: Nadia Swaby, Mississauga (CA); Roger N. A. Francis, Markham (CA); Sri Sreekanth, Mississauga (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 17/320,975

(22) Filed: May 14, 2021

(65) Prior Publication Data

US 2022/0364730 A1 Nov. 17, 2022

(51) Int. Cl.
*F23R 3/28* (2006.01)
*F23R 3/38* (2006.01)

(52) U.S. Cl.
CPC ..... *F23R 3/286* (2013.01); *F23R 3/38* (2013.01); *F23R 2900/00004* (2013.01)

(58) Field of Classification Search
CPC ..... F23R 3/286; F23R 3/28; F23R 3/283; F02C 7/222; F05D 2240/35
See application file for complete search history.

(56) References Cited

U.S. PATENT DOCUMENTS 6,082,113 A 7/2000 Prociw
6,289,676 B1 9/2001 Prociw
6,289,677 B1 9/2001 Prociw
6,345,505 B1 2/2002 Green
6,823,677 B2 11/2004 Prociw
7,654,880 B2 2/2010 Schneider
7,716,933 B2 5/2010 Prociw
7,743,612 B2 6/2010 Morenko
8,096,129 B2 1/2012 Francis
8,205,452 B2 6/2012 Boardman
8,683,804 B2 4/2014 Boardman
9,366,190 B2 6/2016 Cramb
10,001,281 B2 6/2018 Patel
10,054,093 B2 8/2018 Spivey
10,184,665 B2 1/2019 Benjamin
10,228,137 B2 3/2019 Kopp-Vaughan
10,451,282 B2 10/2019 Benjamin
10,563,587 B2 2/2020 Ozem
(Continued)

OTHER PUBLICATIONS

EP search report for EP22173484.1 dated Oct. 7, 2022.

*Primary Examiner* — Katheryn A Malatek
*Assistant Examiner* — Jingchen Liu
(74) *Attorney, Agent, or Firm* — Getz Balich LLC

(57) ABSTRACT

A fuel injector is provided for a turbine engine. This fuel injector includes a fuel nozzle, and the fuel nozzle includes a gallery, one or more feed passages and a plurality of exit passages. The gallery extends within the fuel nozzle circumferentially around an axis between a first end of the gallery and a second end of the gallery. A size of the gallery changes as the gallery extends circumferentially around the axis between the first end of the gallery and the second end of the gallery. The one or more feed passages extend within the fuel nozzle to the gallery. The one or more feed passages are configured to supply fuel to the gallery. The exit passages extend within the fuel nozzle from the gallery. The exit passages are configured to receive the fuel from the gallery.

9 Claims, 14 Drawing Sheets

(56) References Cited

U.S. PATENT DOCUMENTS

| | | | | |
|---|---|---|---|---|
| 10,591,164 | B2 | 3/2020 | Patel | |
| 10,739,006 | B2 | 8/2020 | Patel | |
| 10,760,495 | B2 * | 9/2020 | Hawie | F02C 7/222 |
| 10,941,941 | B2 | 3/2021 | Ramotowski | |
| 2004/0040310 | A1 | 3/2004 | Prociw | |
| 2006/0218925 | A1 | 10/2006 | Prociw | |
| 2007/0204622 | A1 | 9/2007 | Patel | |
| 2011/0197594 | A1 | 8/2011 | Khosla | |
| 2013/0283809 | A1 | 10/2013 | Twardochleb | |
| 2014/0331676 | A1 | 11/2014 | Cramb | |
| 2016/0047315 | A1 | 2/2016 | Mccaldon | |
| 2016/0305327 | A1 | 10/2016 | Patel | |
| 2016/0363320 | A1 | 12/2016 | Benjamin | |
| 2017/0003029 | A1 | 1/2017 | Mook | |
| 2017/0037783 | A1 | 2/2017 | Ryon | |
| 2017/0191457 | A1 | 7/2017 | Spivey | |
| 2019/0093562 | A1 | 3/2019 | Lau | |
| 2019/0234310 | A1 | 8/2019 | Morenko | |
| 2020/0011533 | A1 | 1/2020 | Ramotowski | |
| 2020/0103116 | A1 | 4/2020 | Morenko | |
| 2020/0208841 | A1 * | 7/2020 | Chabaille | F23R 3/28 |
| 2020/0355370 | A1 | 11/2020 | Sylvain | |

* cited by examiner

TAPERED FUEL GALLERY FOR A FUEL NOZZLE

BACKGROUND OF THE DISCLOSURE

1. Technical Field

This disclosure relates generally to a turbine engine and, more particularly, to a fuel injector for the turbine engine.

2. Background Information

A fuel nozzle for a gas turbine engine includes an internal fuel circuit. This fuel circuit is configured to direct fuel through the fuel nozzle to a fuel nozzle outlet for injection into a combustion chamber of the turbine engine. The fuel circuit may include an annular fuel gallery that distributes the fuel to multiple exit passages. While such a fuel nozzle has various benefits, there is still room in the art for improvement.

SUMMARY OF THE DISCLOSURE

According to an aspect of the present disclosure, a fuel injector is provided for a turbine engine. This fuel injector includes a fuel nozzle, and the fuel nozzle includes a gallery, a plurality of feed passages and a plurality of exit passages. The gallery extends within the fuel nozzle circumferentially around an axis between a first end of the gallery and a second end of the gallery. A size of the gallery changes as the gallery extends circumferentially around the axis between the first end of the gallery and the second end of the gallery. The feed passages extend within the fuel nozzle to the gallery. The feed passages are configured to supply fuel to the gallery. The exit passages extend within the fuel nozzle from the gallery. The exit passages are configured to receive the fuel from the gallery.

According to another aspect of the present disclosure, another fuel injector is provided for a turbine engine. This fuel injector includes a fuel nozzle, and the fuel nozzle includes a gallery, a feed passage and a plurality of exit passages. The gallery extends within the fuel nozzle circumferentially around an axis between a first end of the gallery and a second end of the gallery. A size of the gallery decreases as the gallery extends circumferentially around the axis from an intermediate location towards the first end of the gallery. The size of the gallery decreases as the gallery extends circumferentially around the axis from the intermediate location towards the second end of the gallery. The feed passage extends within the fuel nozzle to the gallery. The feed passage is configured to supply fuel to the gallery. The exit passages extend within the fuel nozzle from the gallery. The exit passages are configured to receive the fuel from the gallery.

According to still another aspect of the present disclosure, another fuel injector is provided for a turbine engine. This fuel injector includes a fuel nozzle, and the fuel nozzle includes a gallery, a feed passage and a plurality of exit passages. The gallery extends within the fuel nozzle circumferentially around an axis less than one-hundred and eighty degrees between a first end of the gallery and a second end of the gallery. A size of the gallery changes as the gallery extends circumferentially around the axis between the first end of the gallery and the second end of the gallery. The feed passage extends within the fuel nozzle to the gallery. The feed passage is configured to supply fuel to the gallery. The exit passages extend within the fuel nozzle from the gallery. The exit passages are configured to receive the fuel from the gallery.

The size of the gallery may decrease as the gallery extends circumferentially around the axis away from an intermediate location towards the first end of the gallery. The size of the gallery may decrease as the gallery extends circumferentially around the axis away from the intermediate location towards the second end of the gallery. The feed passage may be fluidly coupled to the gallery at the intermediate location.

The size of the gallery may decrease as the gallery extends circumferentially around the axis from the first end of the gallery towards the second end of the gallery. The feed passage may be fluidly coupled to the gallery at the first end of the gallery.

An axial height of the gallery may change as the gallery extends circumferentially around the axis between the first end of the gallery and the second end of the gallery.

A radial width of the gallery may change as the gallery extends circumferentially around the axis between the first end of the gallery and the second end of the gallery.

A cross-sectional area of the gallery may change as the gallery extends circumferentially around the axis between the first end of the gallery and the second end of the gallery.

The size of the gallery may decrease as the gallery extends circumferentially around the axis from the first end of the gallery to the second end of the gallery.

The feed passages may be fluidly coupled to the gallery at the first end of the gallery.

The feed passages may include a first feed passage that is fluidly coupled with the gallery at a first feed passage orifice. The exit passages may include a first exit passage that is fluidly coupled with the gallery at a first exit passage orifice. The first exit passage orifice may be circumferentially between the first feed passage orifice and the first end of the gallery.

The size of the gallery may decrease as the gallery extends in a first direction circumferentially around the axis from an intermediate location towards the first end of the gallery. The size of the gallery may decrease as the gallery extends in a second direction circumferentially around the axis from the intermediate location towards the second end of the gallery.

At least one of the feed passages may be fluidly coupled to the gallery at the intermediate location.

The gallery may extend, more than two-hundred and seventy degrees and less than three-hundred and sixty degrees, circumferentially around the axis from the first end of the gallery to the second end of the gallery.

The gallery may extend, less than one-hundred and eighty degrees, circumferentially around the axis from the first end of the gallery to the second end of the gallery.

A first of the exit passages may extend along a centerline that is non-parallel with the axis.

The intermediate location may be about circumferentially midway between the first end of the gallery and the second end of the gallery.

The feed passage may extend to and may be fluidly coupled with the gallery at the intermediate location.

A first set of the exit passages may extend from and may be fluidly coupled with the gallery circumferentially between the first end of the gallery and the intermediate location.

A second set of the exit passages may extend from and may be fluidly coupled with the gallery circumferentially between the second end of the gallery and the intermediate location.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
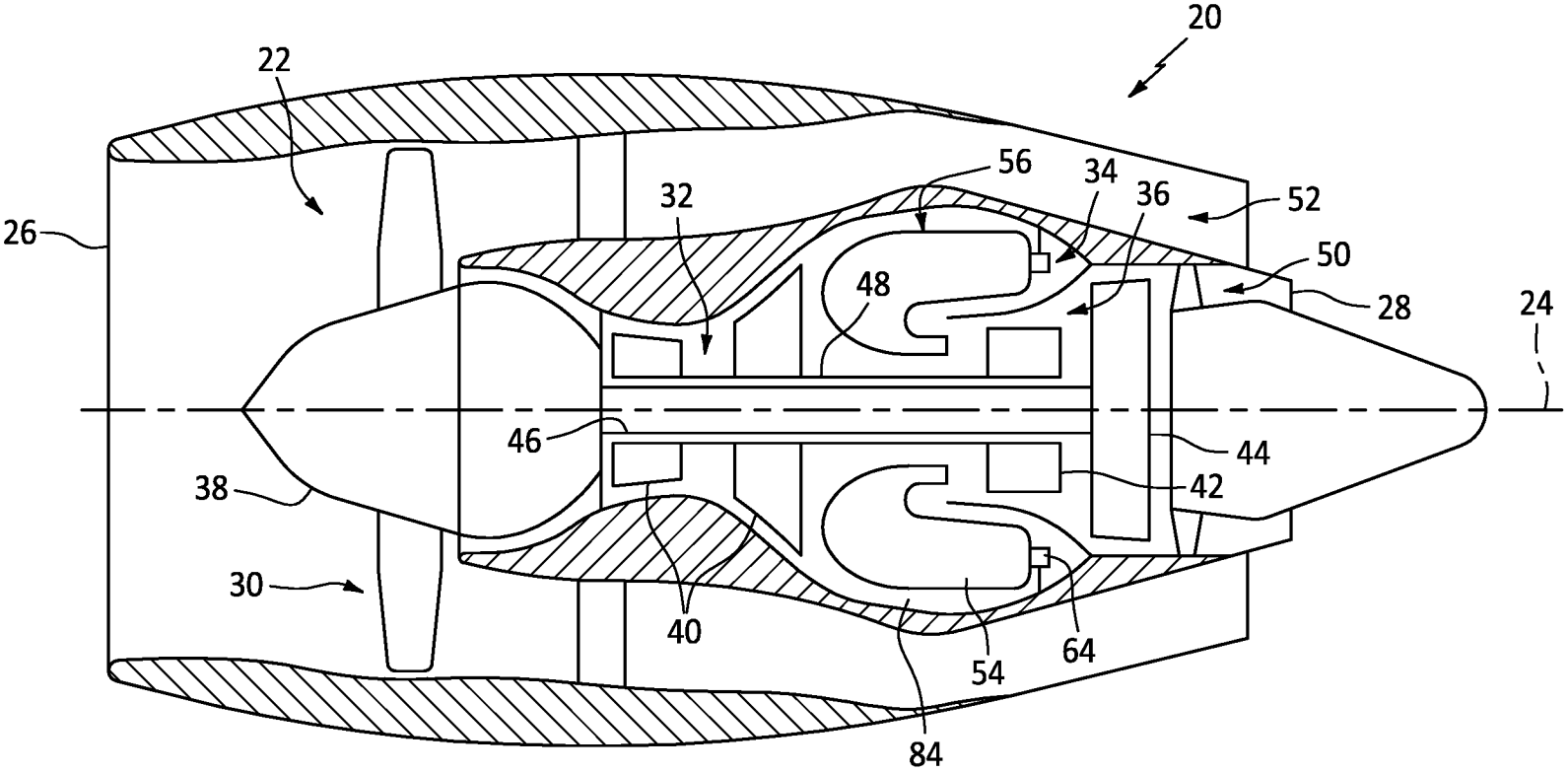
FIG. 1 is a side sectional schematic illustration of an aircraft propulsion system.

FIG. 1 illustrates an aircraft propulsion system 20 with a turbofan gas turbine engine 22. This turbine engine 22 extends along a centerline 24 of the engine 22 between an upstream airflow inlet 26 and a downstream airflow exhaust 28. The turbine engine 22 includes a fan section 30, a compressor section 32, a combustor section 34 and a turbine section 36.

The fan section 30 includes a fan rotor 38. The compressor section 32 includes a compressor rotor 40. The turbine section 36 includes a high pressure turbine (HPT) rotor 42 and a low pressure turbine (LPT) rotor 44, where the LPT rotor 44 is configured as a power turbine rotor. Each of these rotors 38, 40, 42 and 44 includes a plurality of rotor blades arranged circumferentially around and connected to one or more respective rotor disks.

The fan rotor 38 is connected to the LPT rotor 44 through a low speed shaft 46. The compressor rotor 40 is connected to the HPT rotor 42 through a high speed shaft 48. The low speed shaft 46 and the high speed shaft 48 of FIG. 1 are concentric with one another and rotatable about the engine centerline 24; e.g., a rotational axis. The low speed shaft 46 extends through a bore of the high speed shaft 48 between the fan rotor 38 and the LPT rotor 44.

During operation, air enters the turbine engine 22 through the airflow inlet 26. This air is directed through the fan section 30 and into a core flowpath 50 and a bypass flowpath 52. The core flowpath 50 extends sequentially through the engine sections 32, 34 and 36; e.g., an engine core. The air within the core flowpath 50 may be referred to as "core air". The bypass flowpath 52 extends through a bypass duct, which bypasses the engine core. The air within the bypass flowpath 52 may be referred to as "bypass air".

The core air is compressed by the compressor rotor 40 and directed into an annular combustion chamber 54 of an annular combustor 56 in the combustor section 34. Fuel is injected into the combustion chamber 54 and mixed with the compressed core air to provide a fuel-air mixture. This fuel-air mixture is ignited and combustion products thereof flow through and sequentially cause the HPT rotor 42 and the LPT rotor 44 to rotate. The rotation of the HPT rotor 42 drives rotation of the compressor rotor 40 and, thus, compression of air received from an inlet into the core flowpath 50. The rotation of the LPT rotor 44 drives rotation of the fan rotor 38, which propels bypass air through and out of the bypass flowpath 52. The propulsion of the bypass air may account for a significant portion (e.g., a majority) of thrust generated by the turbine engine 22.

Figure 2:
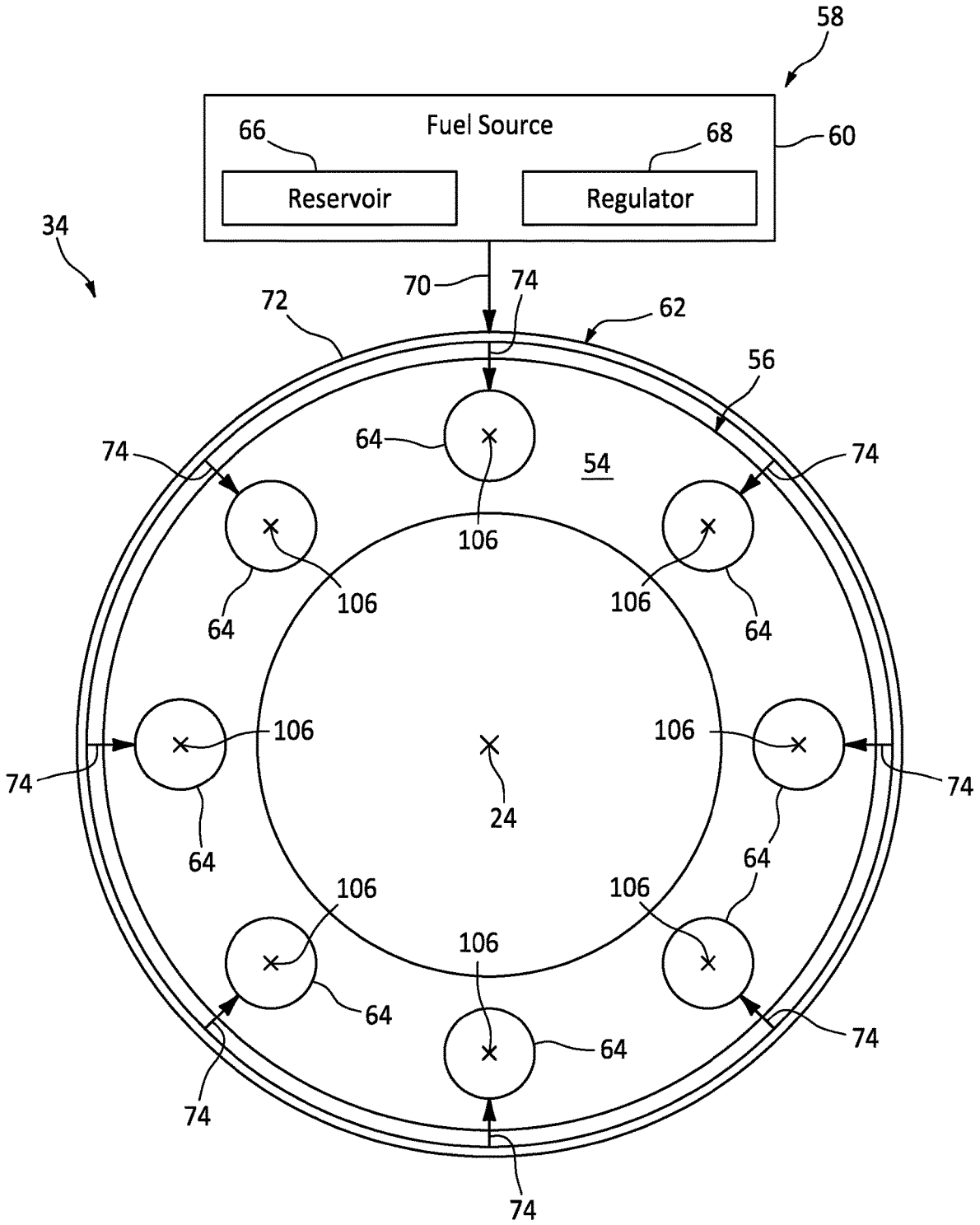
FIG. 2 is a cross-sectional schematic illustration of a fuel system for delivering fuel to a turbine engine combustor.

Referring to FIG. 2, the turbine engine 22 includes a fuel system 58 for injecting the fuel into the combustion chamber 54. This fuel system 58 includes a fuel source 60, a fuel supply circuit 62 and one or more fuel injectors 64.

The fuel source 60 of FIG. 2 includes a fuel reservoir 66 and a fuel regulator 68. The fuel reservoir 66 may be configured as or otherwise include a container; e.g., a tank, a cylinder, a pressure vessel, a bladder, etc. The fuel reservoir 66 is configured to contain and hold a quantity of the fuel. The fuel regulator 68 may be configured as or otherwise include a pump and/or a valve. The fuel regulator 68 is configured to control flow of the fuel from the fuel reservoir 66 to one or more downstream components of the fuel system 58. The fuel regulator 68 of FIG. 2, for example, directs (e.g., pumps) the fuel out from the fuel reservoir 66 to the fuel supply circuit 62 for delivery to fuel injectors 64.

The fuel supply circuit 62 is configured to deliver the fuel received from the fuel source 60 to the fuel injectors 64. The fuel supply circuit 62 of FIG. 2, for example, includes a fuel supply circuit input passage 70, a fuel supply circuit manifold 72 and one or more fuel supply circuit output passages 74. The input passage 70 is between, connected to and fluidly couples the fuel source 60 and the manifold 72. The manifold 72 is between, connected to and fluidly couples the input passage 70 and the output passages 74. The manifold 72 is thereby operable to (e.g., substantially evenly) distribute the fuel received from the fuel source 60 through the input passage 70 to the output passages 74. Each of the output passages 74 is between, connected to and fluidly couples the manifold 72 and a respective one of the fuel injectors 64. Each output passage 74 is thereby operable to direct the fuel received from the manifold 72 to the respective fuel injector 64.

Figure 3:
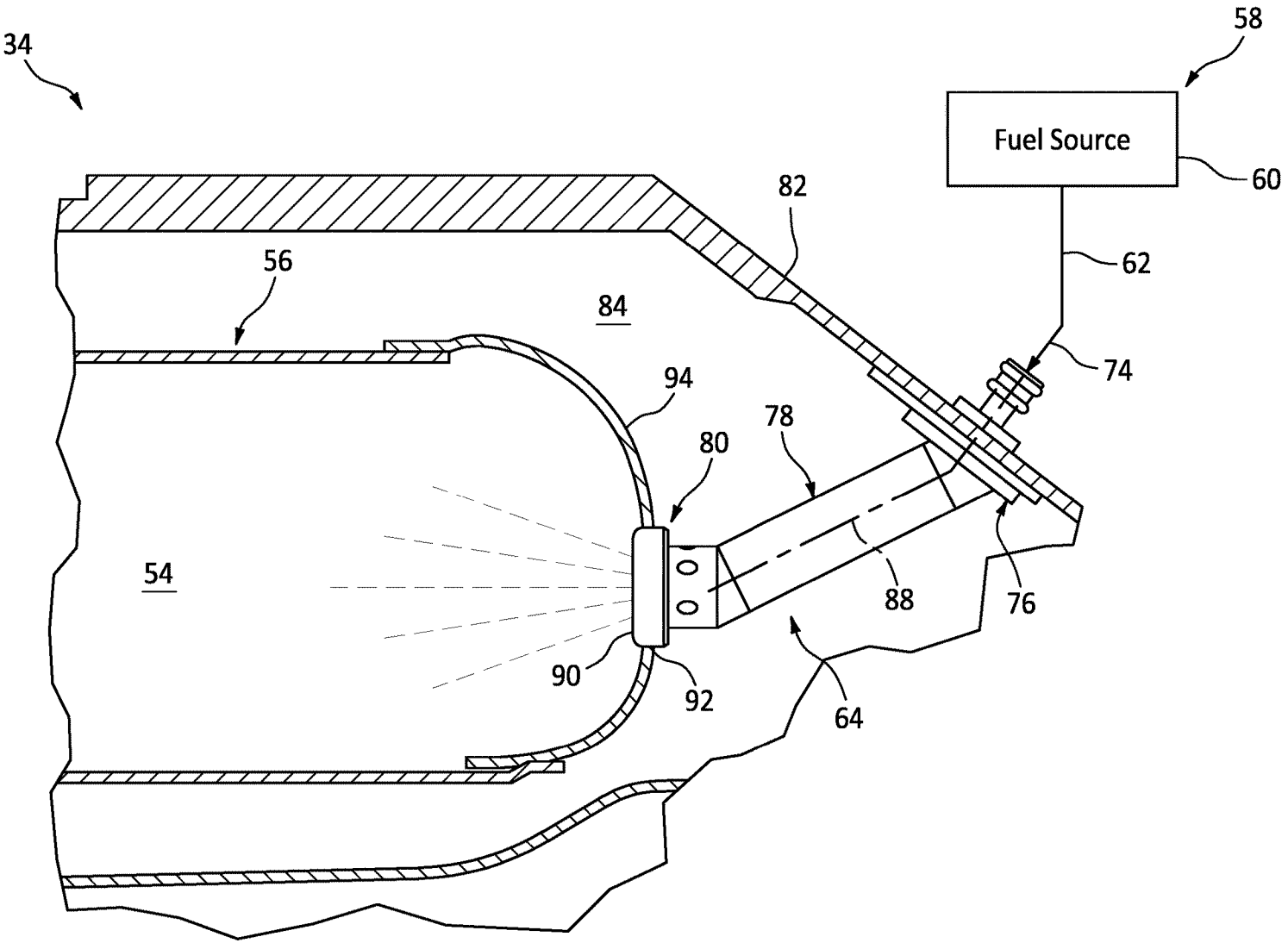
FIG. 3 is a partial side sectional illustration of the turbine engine combustor and the fuel delivery system.

The fuel injectors 64 of FIG. 2 are arranged circumferentially about the engine centerline 24 in an annular array. Referring to FIG. 3, each fuel injector 64 includes a fuel injector base 76, a fuel injector stem 78 and a fuel injector nozzle 80, referred to below as a "fuel nozzle".

The injector base 76 is configured to connect the respective fuel injector 64 to a static structure of the turbine engine 22. The injector base 76 of FIG. 3, for example, mounts the respective fuel injector 64 and its injector stem 78 to a case 82 of the turbine engine 22. Briefly, this turbine engine case 82 may be configured as a diffuser case. The turbine engine case 82 of FIG. 3, for example, is spaced from and circumscribes the combustor 56 so as to at least partially form a diffuser plenum 84 surrounding the combustor 56.

The injector stem 78 is configured to locate and support the fuel nozzle 80. The injector stem 78, for example, structurally connects the fuel nozzle 80 to the injector base 76. The injector stem 78 of FIG. 3 extends within/through the diffuser plenum 84 from the injector base 76 to the fuel nozzle 80. The injector stem 78 also forms and/or shields at least one internal fuel injector fuel conduit 88 that fluidly couples a respective one of the output passages 74 to the fuel nozzle 80.

Figure 4:
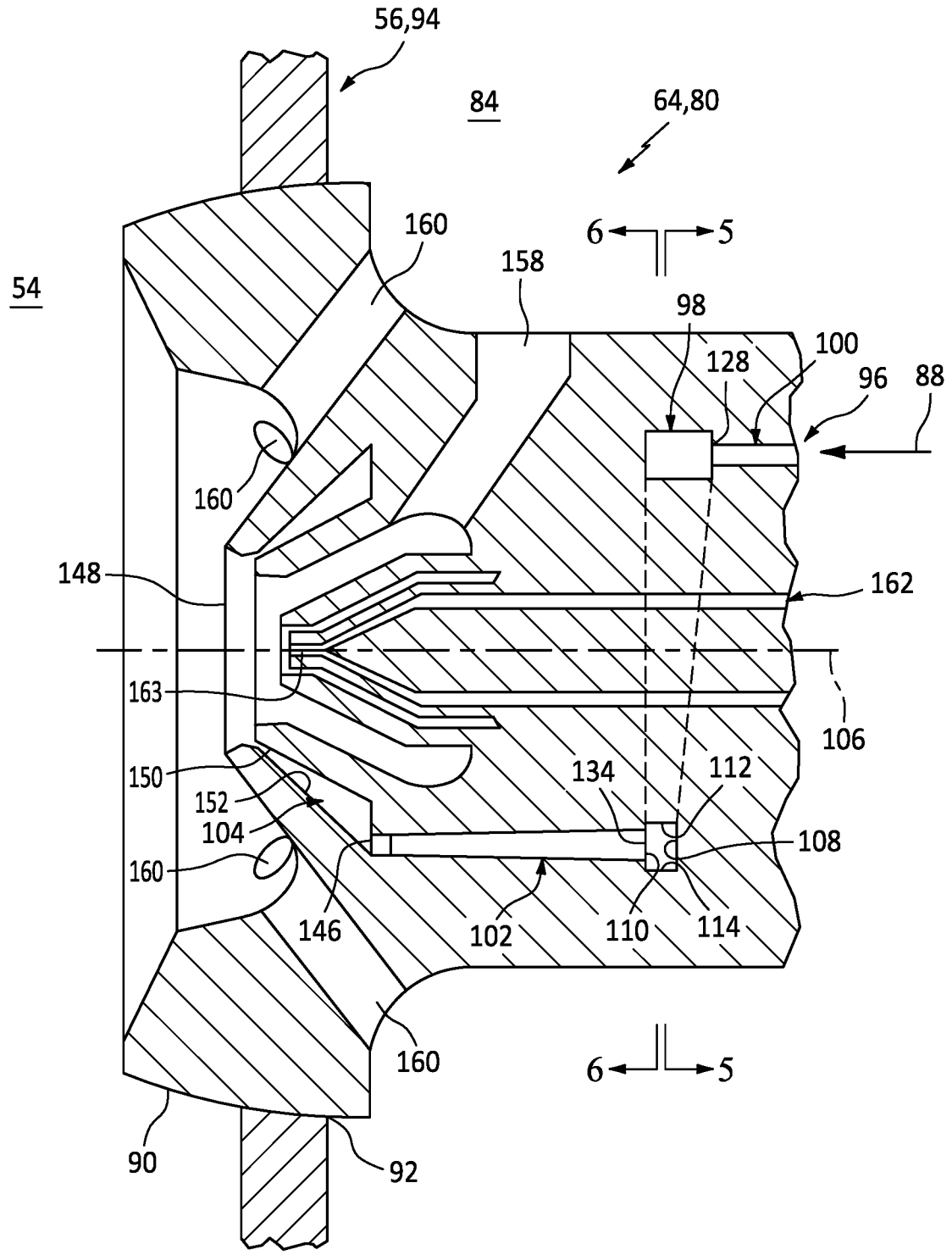
FIG. 4 is a side sectional illustration of a fuel nozzle arranged with portion of a combustor wall.

Referring to FIG. 4, the fuel nozzle 80 is mated with the combustor 56. A head 90 of the fuel nozzle 80 of FIG. 4, for example, is received by and may project through a receptacle 92 in a wall 94 of the combustor 56; e.g., an opening in an annular bulkhead of the combustor 56. The fuel nozzle head 90 may be configured to float within the receptacle 92. Alternatively, the fuel nozzle head 90 may be fixedly attached to the combustor wall 94.

The fuel nozzle 80 of FIG. 4 includes an internal fuel nozzle circuit 96. This fuel nozzle circuit 96 is configured to receive the fuel from the fuel conduit 88 and direct that received fuel out of the fuel nozzle head 90 into the combustion chamber 54. The fuel nozzle circuit 96 of FIG. 4 includes an arcuate (non-annular) fuel gallery 98, one or more fuel feed passages 100A and 100B (generally referred to as "100") and a plurality of fuel exit passages 102A-D (generally referred to as "102"); see also FIGS. 5 and 6. The fuel nozzle circuit 96 of FIG. 4 may also include an annular fuel film passage 104.

Figure 5:
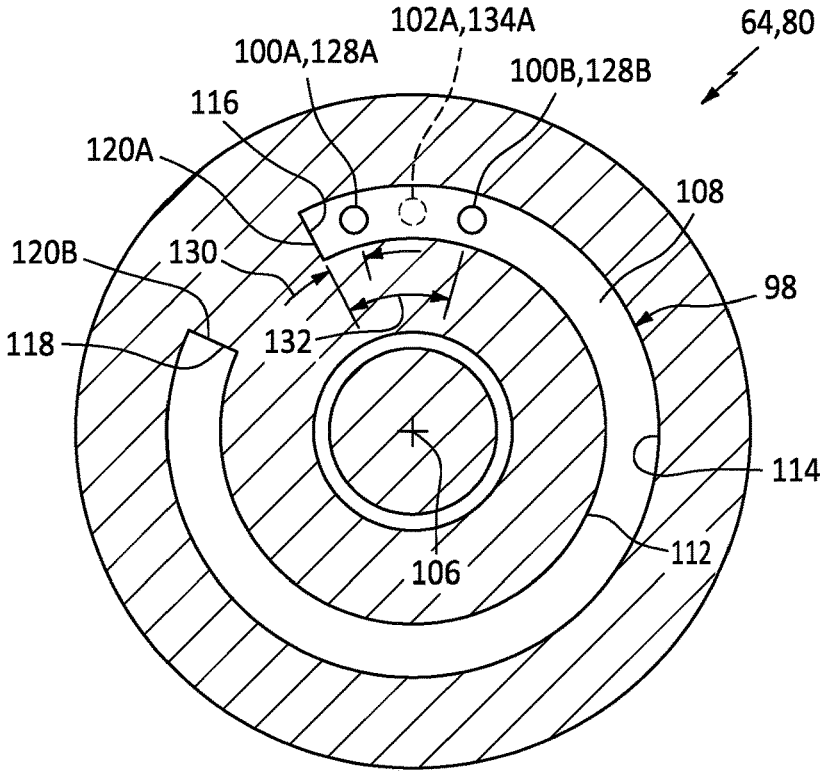
FIG. 5 is a cross-sectional illustration of the fuel nozzle taken along line 5-5 in FIG. 4.
Figure 6:
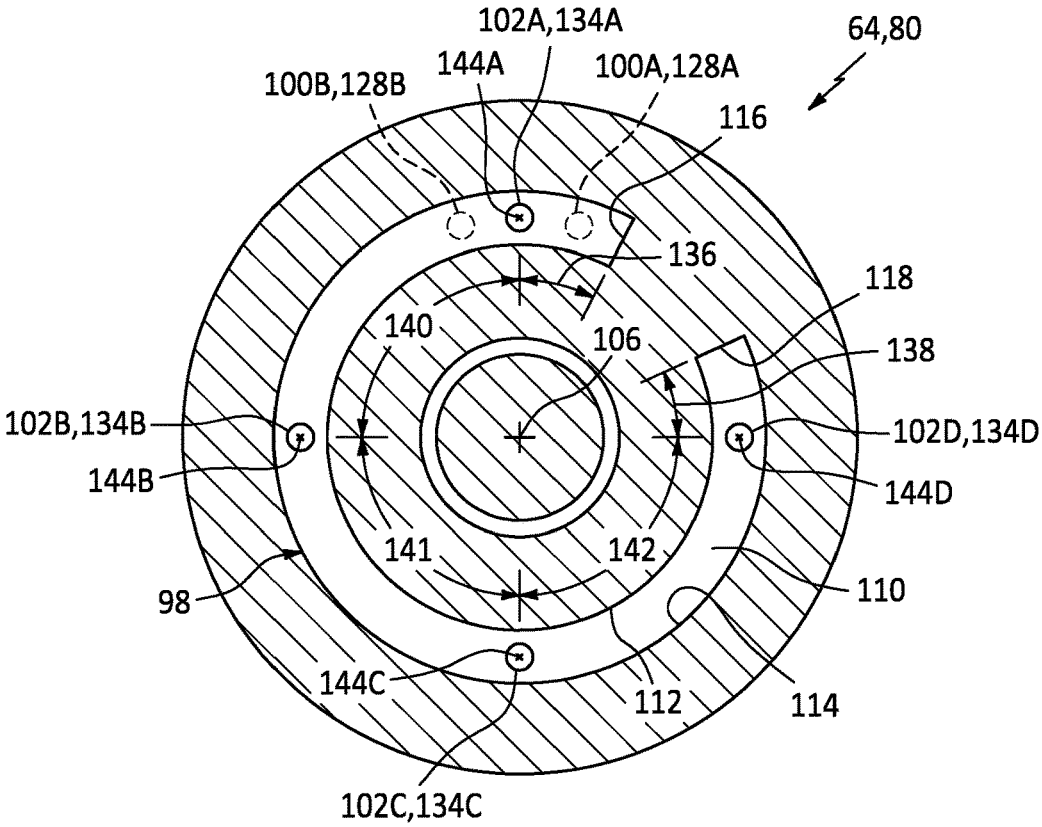
FIG. 6 is a cross-sectional illustration of the fuel nozzle taken along line 6-6 in FIG. 4.

The fuel gallery 98 extends axially within the fuel nozzle 80 along an axis 106 between and to an axial first (e.g., back, upstream) side 108 of the fuel gallery 98 and an opposite axial second (e.g., front, downstream) side 110 of the fuel gallery 98, which axis 106 may be an axial centerline and/or a spray axis of the fuel nozzle 80. The fuel gallery 98 extends radially within the fuel nozzle 80 relative to the axis 106 between and to a radial inner side 112 of the fuel gallery 98 and an opposite radial outer side 114 of the fuel gallery 98. Referring to FIGS. 5 and 6, the fuel gallery 98 extends circumferentially within the fuel nozzle 80 partially around the axis 106 between and to a circumferential first end 116 of the fuel gallery 98 and an opposite circumferential second end 118 of the fuel gallery 98. More particularly, the fuel gallery 98 extends circumferentially around the axis 106 from the gallery first end 116 to the gallery second end 118 more than two-hundred and seventy degrees (270°) but less than three-hundred and sixty degrees (360°). The fuel gallery 98 of FIGS. 5 and 6, for example, extends between three-hundred and fifteen degrees (315°) and three-hundred and forty-five degrees (345°); e.g., about (e.g., +/−2°) three-hundred and thirty degrees (330°). The present disclosure, of course, is not limited to such an exemplary fuel gallery configuration. The fuel gallery 98, for example, may extend less than two-hundred and seventy degrees (270°) circumferentially around the axis 106 from the gallery first end 116 to the gallery second end 118; e.g., between one-hundred and eighty degrees (180°) and two-hundred and seventy degrees (270°).

The fuel gallery first end 116 may be configured as an upstream end of the fuel gallery 98. The fuel gallery second end 118 may be configured as a downstream end of the fuel gallery 98.

Figure 7:
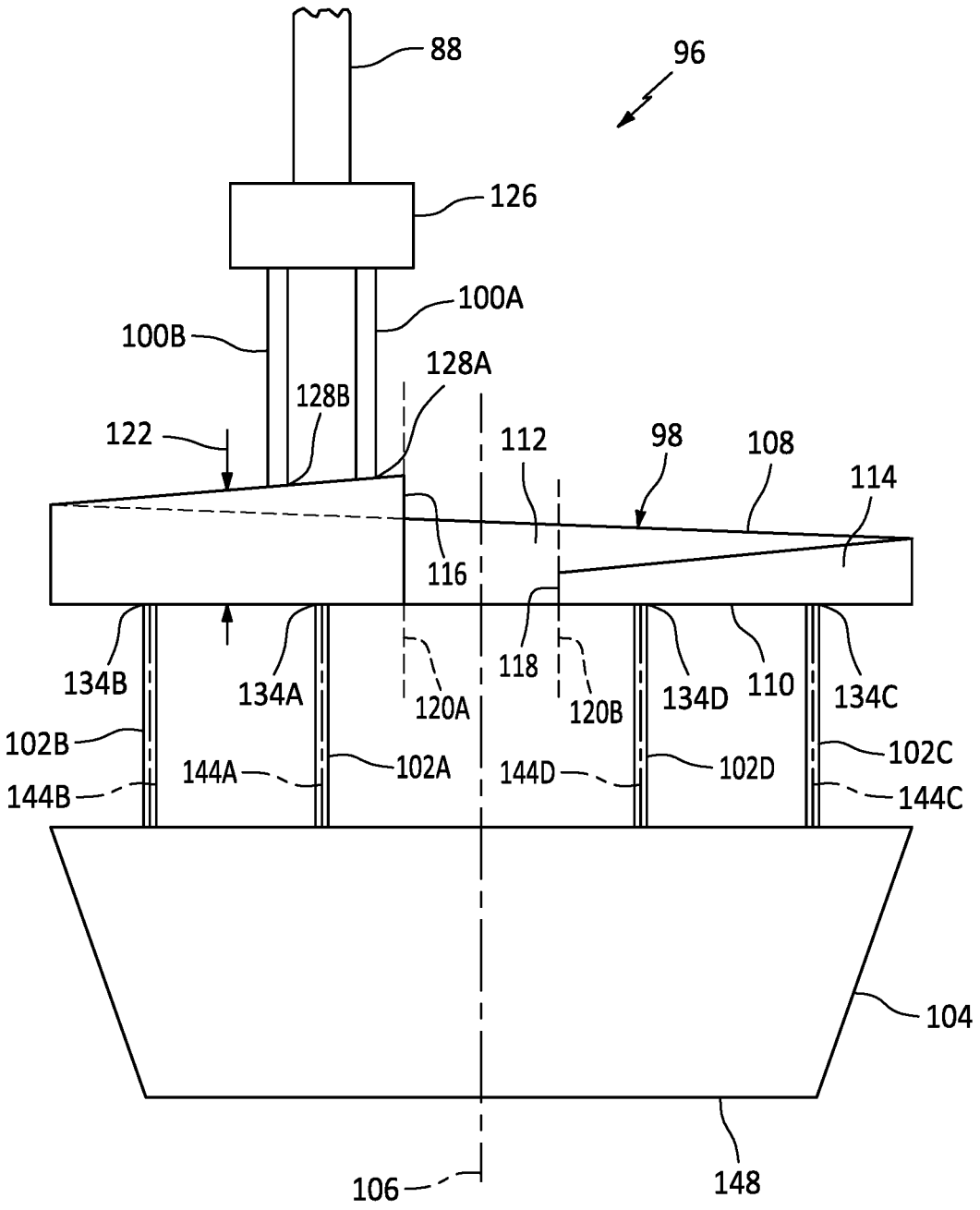
FIGS. 7 and 8 are side illustrations of a fuel nozzle circuit within the fuel nozzle, where internal volumes of the fuel nozzle circuit are positively depicted.
Figure 8:
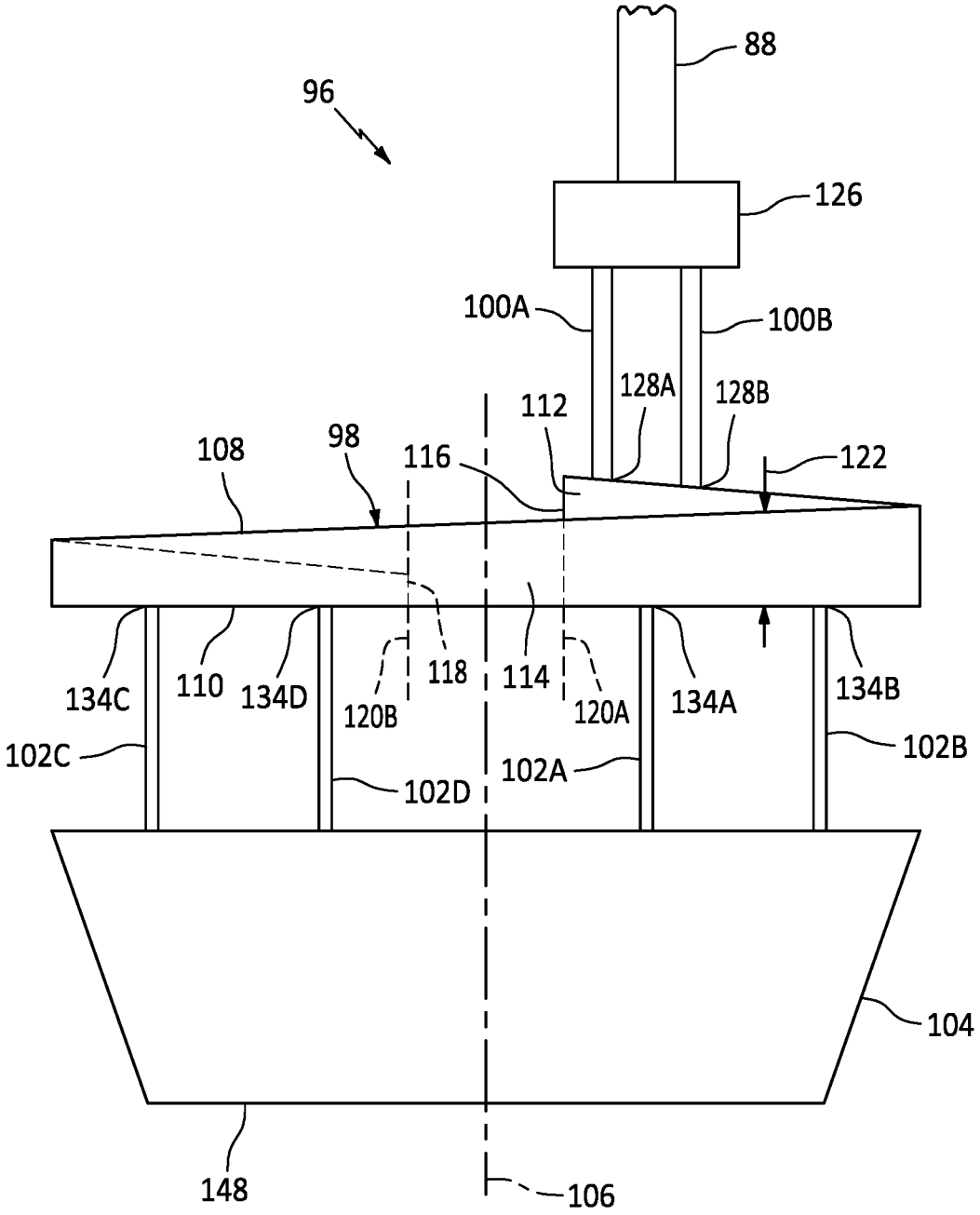
Figure 9:
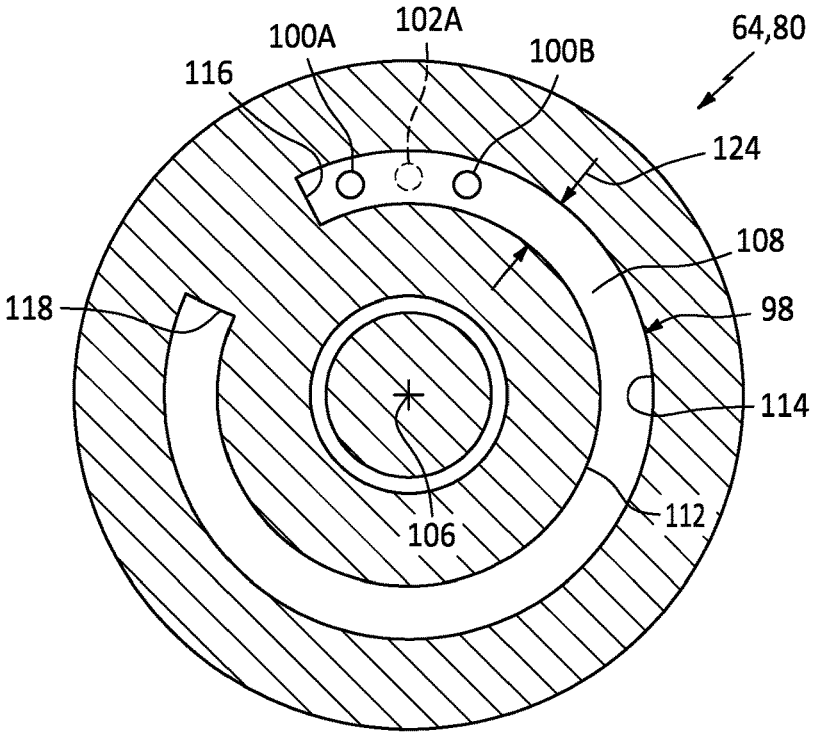
FIG. 9 is a cross-sectional illustration of the fuel nozzle configured with a radially tapering fuel gallery.

Referring to FIGS. 7 and 8, the fuel gallery 98 is configured with a size that continuously (or intermittently) changes as the fuel gallery 98 extends circumferentially around the axis 106 from or about the gallery first end 116 to or about the gallery second end 118. A cross-sectional area of the fuel gallery 98, for example, may continuously (or intermittently) decrease as the fuel gallery 98 extends circumferentially around the axis 106 from or about the gallery first end 116 to or about the gallery second end 118. Thus, the fuel gallery cross-sectional area in a first plane 120A (e.g., parallel and coincident with the axis 106) located at (e.g., on, adjacent or proximate) the gallery first end 116 may be larger than the fuel gallery cross-sectional area in a second plane 120B (e.g., parallel and coincident with the axis 106) located at (e.g., on, adjacent or proximate) the gallery second end 118; see also FIG. 5. This change in the fuel gallery cross-sectional area may be provided by continuously (or intermittently) changing an axial length 122 of the fuel gallery 98 between the opposing gallery sides 108 and 110. The change in the fuel gallery cross-sectional area may also or alternatively be provided by continuously (or intermittently) changing a radial height 124 of the fuel gallery 98 between the opposing gallery sides 112 and 114; see FIG. 9. Furthermore, while a geometry (e.g., shape) of the fuel gallery 98 may remain substantially constant as the fuel gallery 98 extends circumferentially around the axis 106 as shown in FIGS. 4-7, this fuel gallery geometry may alternatively change as the fuel gallery 98 extends circumferentially around the axis 106 in other embodiments. The fuel gallery cross-sectional area may thereby also or alternatively be changed by changing the fuel gallery geometry.

Referring to FIGS. 7 and 8, the feed passages 100 are configured to fluidly couple the fuel conduit 88 to the fuel gallery 98. The feed passages 100 of FIGS. 7 and 8, for example, are fluidly coupled to the fuel conduit 88 in parallel through, for example, a coupling 126. This coupling 126 may be configured as a manifold or another type of junction; e.g., T-junction, Y-junction, etc. Each of the feed passages 100 extends within (or into) the fuel nozzle 80 (see FIG. 4) to the fuel gallery 98. Each of the feed passages 100 of FIG. 5, for example, has a respective feed passage orifice 128A, 128B (generally referred to as "128") (e.g., a feed passage outlet orifice, a fuel gallery inlet orifice) in the gallery first side 108.

The feed passage orifices 128 are located at (e.g., on, adjacent or proximate) the gallery first end 116; see also FIGS. 7 and 8. The feed passage orifice 128A, for example, is spaced slightly circumferentially from the gallery first end 116 by a circumferential distance 130. The feed passage orifice 128B is spaced more circumferentially from the gallery first end 116 by a circumferential distance 132 that may be different (e.g., greater) than the circumferential distance 130. Thus, the feed passage orifice 128A may be located circumferentially between the feed passage orifice 128B and the gallery first end 116. The present disclosure, however, is not limited to the foregoing exemplary relative feed passage orifice arrangement. For example, in other embodiments, the feed passage orifices 128 may be equally spaced from the gallery first end 116. In still other embodiments, one or each of the feed passage orifices 128 may be located directly adjacent or on the gallery first end 116.

Each of the feed passages 100 has a cross-sectional area when viewed, for example, perpendicular to a longitudinal centerline of the respective feed passage 100. The feed passage cross-sectional areas may be equal. Alternatively, one of the cross-sectional area of one of the feed passages 100 (e.g., the feed passage 100A or the feed passage 100B) may be different (e.g., greater or less) than the cross-sectional area of the other feed passage 100 (e.g., the feed passage 100B or the feed passage 100A).

The exit passages 102 of FIG. 4 are configured to fluidly couple the fuel gallery 98 to the fuel film passage 104. Each of the exit passages 102 of FIG. 4, for example, extends within the fuel nozzle 80 between and to the fuel gallery 98 and the fuel film passage 104. Referring to FIGS. 7 and 8, the exit passages 102 are thereby fluidly coupled in parallel between the fuel gallery 98 and the fuel film passage 104.

Referring to FIG. 6, the exit passages 102 are arranged circumferentially around the axis 106 in an annular (or acuate) array. Each of the exit passages 102 of FIG. 6 has a respective exit passage orifice 134A-D (e.g., an exit passage inlet orifice, a fuel gallery outlet orifice) in the gallery second side 110.

The (e.g., upstream-most) exit passage orifice 134A is located at (e.g., on, adjacent or proximate) the gallery first end 116; see also FIGS. 7 and 8. The exit passage 102A, for example, is spaced slightly circumferentially from the gallery first end 116 by a circumferential distance 136. This circumferential distance 136 may be greater than the circumferential distance 130 and less than the circumferential distance 132; see FIG. 5. Thus, the exit passage 102A may be located circumferentially between the feed passage orifice 128A and the feed passage orifice 128B. The exit passage 102A is located circumferentially between the feed passage orifice 128B and the gallery first end 116. The feed passage orifice 128A is located circumferentially between the exit passage orifice 134A and the gallery first end 116. The present disclosure, however, is not limited to the foregoing exemplary relative exit passage orifice arrangement. For example, in other embodiments, the exit passage 102A may be circumferentially aligned with one or each of the feed passage orifices 128; e.g., the circumferential distance 136 may be equal to the circumferential distance 130 and/or 132. The exit passage orifice 134A may be located circumferentially between each feed passage orifice 128 and the gallery first end 116, or vice versa. In addition or alternatively, the exit passage 102A may be located directly adjacent or on the gallery first end 116.

The (e.g., downstream-most) exit passage orifice 134D is located at (e.g., on, adjacent or proximate) the gallery second end 118; see also FIGS. 7 and 8. The exit passage 102D, for example, is spaced slightly circumferentially from the gallery second end 118 by a circumferential distance 138. This circumferential distance 138 may be equal to or different (e.g., greater or less) than the circumferential distance 136. The present disclosure, however, is not limited to the foregoing exemplary relative exit passage orifice arrangement. For example, in other embodiments, the exit passage 102D may be located directly adjacent or on the gallery second end 118.

The (e.g., intermediate) exit passage orifice 134B and the (e.g., intermediate) exit passage orifice 134C are located at discrete locations circumferentially between the exit passage orifice 134A and the exit passage orifice 134D. The exit passage orifice 134B is spaced circumferentially from the exit passage orifice 134A by a circumferential distance 140. The exit passage orifice 134B is spaced circumferentially from the exit passage orifice 134C by a circumferential distance 141. The exit passage orifice 134C is spaced circumferentially from the exit passage orifice 134D by a circumferential distance 142. The circumferential distances 140-142 may be equal such that the exit passages 102 and the orifices 134 are arranged equispaced about the axis 106. In other embodiments, however, one or more of the circumferential distances 140-142 may be different than the other(s).

Each of the exit passages 102 has a cross-sectional area when viewed, for example, perpendicular to a longitudinal centerline 144A-D (generally referred to as "144") of the respective exit passage 102. The exit passage cross-sectional areas may be equal. Alternatively, one of the cross-sectional area of one or more of the exit passages 102 may be different (e.g., greater or less) than the cross-sectional area of one or more of the other exit passages 102.

Figure 10:
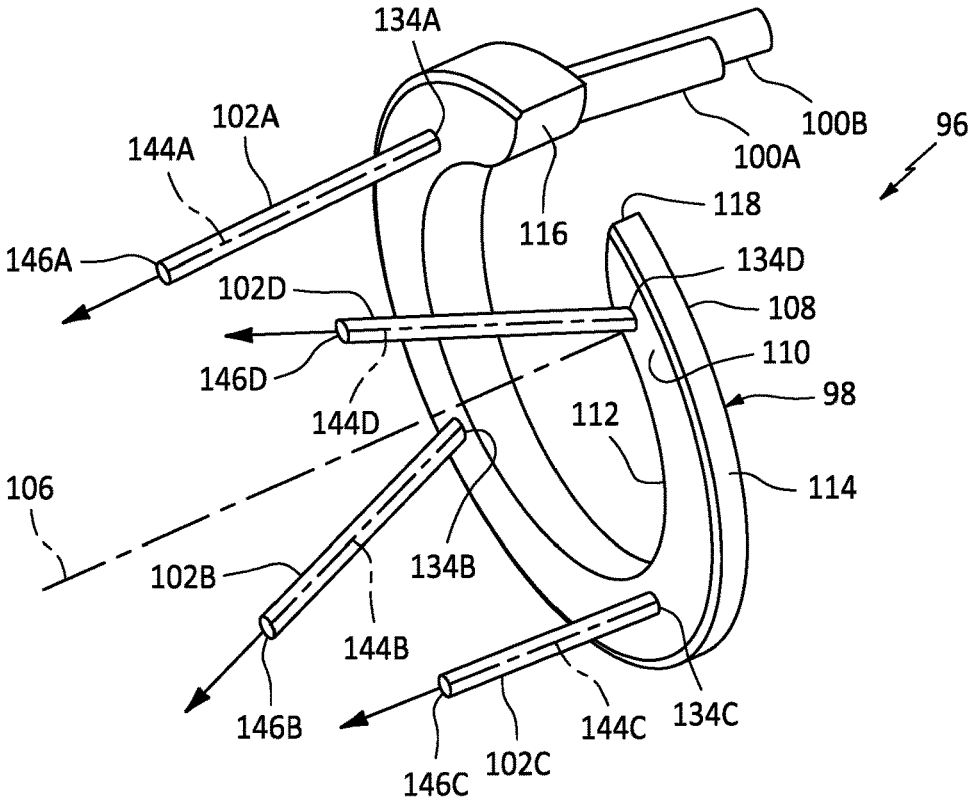
FIG. 10 is a perspective illustration of a portion of the fuel nozzle circuit configured with skewed exit passages, where the internal volumes of the fuel nozzle circuit are positively depicted.

Referring to FIG. 7, at least a portion or an entirety of each exit passage longitudinal centerline 144 may be configured parallel with the axis 106. Alternatively, referring to FIG. 10, one or more or each of the exit passage longitudinal centerline 144 may be configured non-parallel with the axis 106. Each exit passage longitudinal centerlines 144 of FIG. 10, for example, is circumferentially skewed such that its inlet orifice (the exit passage orifice 134) is circumferentially offset to its outlet orifice 146A-D (generally referred to as "146"). The inlet orifice (the exit passage orifice 134) may also or alternatively be radially offset from the outlet orifice 146 such that the respective exit passage longitudinal centerline 144 is also or alternatively radially skewed.

Referring to FIG. 4, the fuel film passage 104 is configured to fluidly couple the exit passages 102 with a plenum outside of the fuel nozzle head 90; e.g., the combustion chamber 54. The fuel film passage 104 of FIG. 4, for example, extends axially within the fuel nozzle 80 along the axis 106 between and to the exit passages 102 and their outlet orifices 146 to a fuel nozzle outlet orifice 148 at a distal end of the fuel nozzle head 90. The fuel film passage 104 extends radially within the fuel nozzle 80 between and to a (e.g., frustoconical) radial inner surface 150 and an opposing (e.g., frustoconical) radial outer surface 152. The fuel film passage 104 extends circumferentially completely around the axis 106, thereby configuring the fuel film passage 104 as an annulus; e.g., a frustoconical annular passage.

During fuel injector operation, the fuel conduit 88 delivers the fuel to the feed passages 100. The feed passages 100 direct the received fuel into the fuel gallery 98. The fuel gallery 98 distributes the fuel to the exit passages 102. Each exit passage 102 injects the fuel as a jet into the fuel film passage 104 to impinge against the film passage outer surface 152. This impingement may disperse the fuel jet into a film and/or may vaporize the fuel. The fuel film passage 104 directs the fuel (e.g., film of vaporized fuel) out of the fuel nozzle head 90 via the fuel nozzle outlet orifice 148 and into the combustion chamber 54 for subsequent ignition and combustion.

Figure 11:
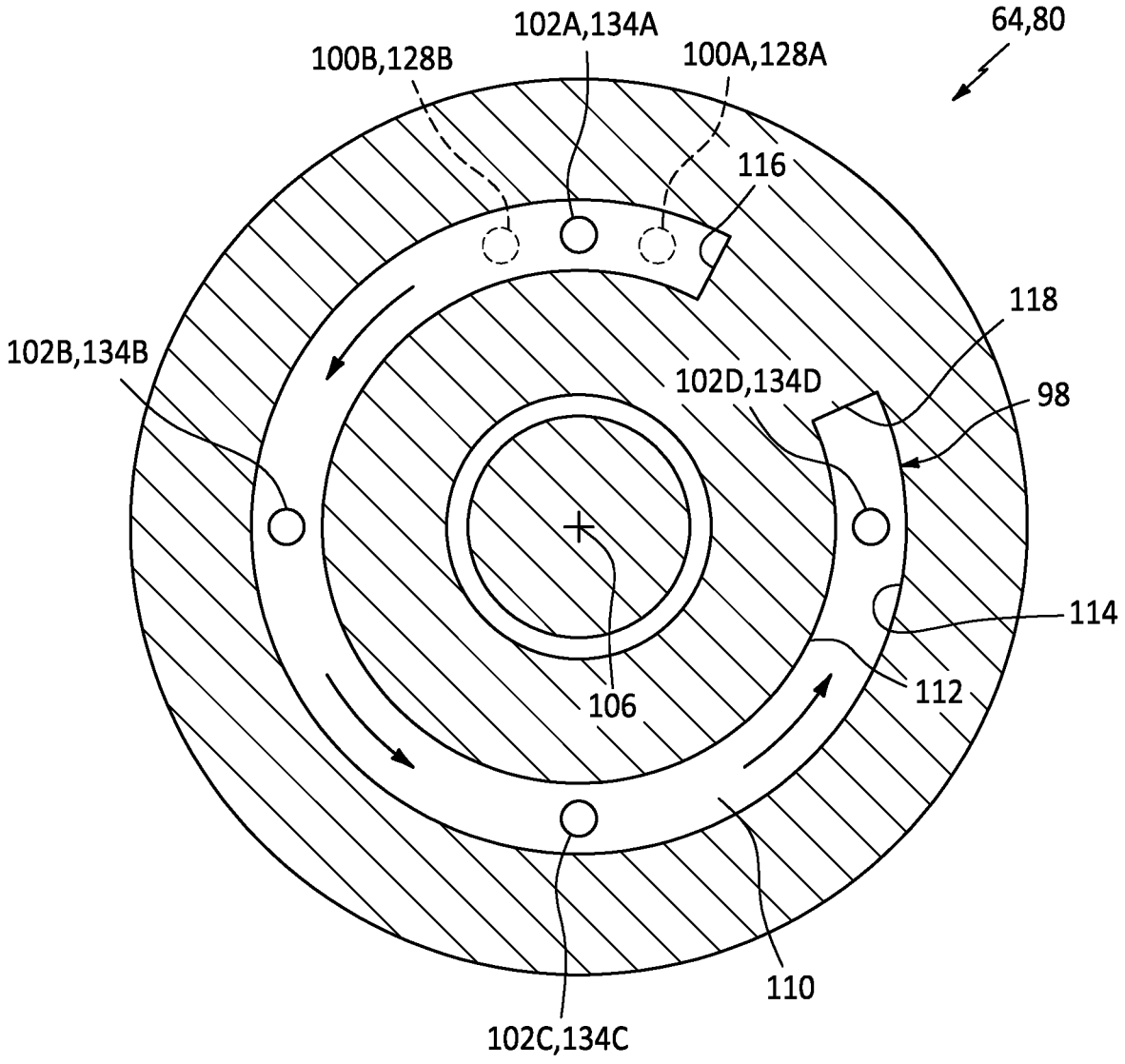
FIG. 11 is a cross-sectional illustration of the fuel nozzle depicted with fuel flowing within an arcuate fuel gallery.

Within the fuel gallery 98 of FIG. 11, the fuel flows circumferentially in a (e.g., counterclockwise) direction from the gallery first end 116 to the gallery second end 118 and is (e.g., substantially equally) distributed to each of the exit passage orifices 134. Since the fuel gallery 98 tapers (e.g., its cross-sectional area decreases) as the fuel gallery 98 extends from the gallery first end 116 to the gallery second end 118, a velocity of the fuel at and/or about each exit passage orifice 134 may be substantially equal. For example, the velocity of the fuel flowing within the fuel gallery 98 at and/or about the exit passage orifice 134A may be approximately equal to (e.g., within +/−5% or 10%) the velocity of the fuel flowing within the fuel gallery 98 at and/or about the exit passage orifice 134D. The fuel gallery 98, more particularly, is tailored to maintain an approximately uniform fuel velocity within the fuel gallery 98. By maintaining a relatively high velocity of fuel flowing through the fuel gallery 98, there is less time for the fuel flowing through the fuel gallery 98 to heat up and possibly coke (e.g., form hardened deposits, sediment) along walls of the fuel gallery 98.

Figure 12:
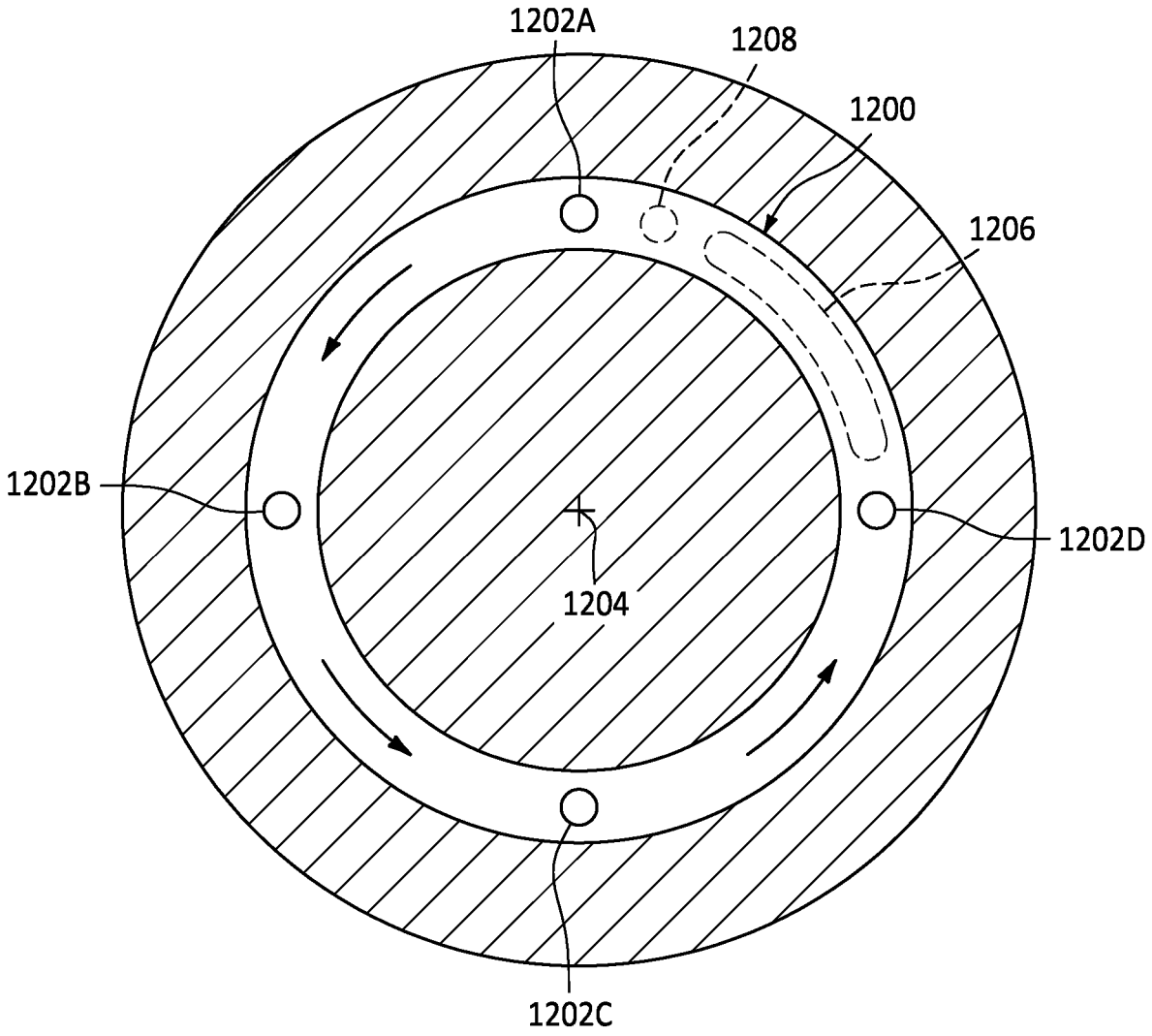
FIG. 12 (PRIOR ART)
FIG. 12 is a cross-sectional illustration of a prior art fuel nozzle depicted with fuel flowing within an annular fuel gallery.

By contrast, FIG. 12 illustrates a prior art fuel gallery 1200 with a constant cross-sectional geometry. With such a configuration, velocity of the fuel about each orifice (e.g., 1202A, B, C) is greater than the velocity of the fuel about each downstream orifice (e.g., 1202B, C, D) since some of the fuel is directed out of the fuel gallery 1200 at the upstream orifice (e.g., 1202A, B, C) and the flow area of the fuel gallery 1200 does not change. The fuel downstream of the upstream orifice (e.g., 1202A, B, C) is therefore subject to an increased likelihood of coking since that fuel spends more time flowing within the fuel gallery 1200 and being heated before exiting.

The fuel gallery 1200 of FIG. 12 has an annular (full hoop) configuration. Since the fuel may tend to flow in a certain direction about an axis 1204, a low flow/dead area 1206 may develop circumferentially between an inlet 1208 to the fuel gallery 1200 and the downstream-most outlet orifice 1202D. The fuel within this dead area 1206 may have a relatively low velocity and/or may recirculated within this dead area 1206. The fuel within the dead area 1206 may thereby be subject to an even higher likelihood of coking within the fuel gallery 1200. By contrast, the fuel gallery 98 of the FIG. 11 has an arcuate configuration to eliminate or substantially reduce a size of such a dead area.

As turbine engines are designed to continuously increase in efficiency and thrust capabilities while decrease in size and weight, fuel injectors may be designed to flow/inject less and less fuel. Decreasing fuel flow to the fuel injectors may consequently decrease fuel flow velocity to the fuel injectors. As discussed above, the longer fuel remains in a relatively hot environment such as a fuel nozzle, the more likely that fuel is to coke within the fuel nozzle. The fuel nozzle configuration of the present disclosure is particularly suited for accommodating such lower velocity fuel flows as discussed above.

The fuel nozzle 80 of FIGS. 7 and 8, for example, is also particularly suited for accommodating fuel system designs with limited fuel pressure available to each fuel injector 64; see FIG. 4. For example, by providing the fuel nozzle circuit 96 of FIGS. 7 and 8 with two or more of the feed passages 100, a smaller fuel pressure drop between the fuel conduit 88 and the fuel gallery 98 can be provided as compared to a fuel nozzle circuit with a similarly sized, single feed passage; e.g., see FIG. 12. Note, as fuel injectors and their nozzles are designed with smaller and smaller sizes, sizes of corresponding passages within the fuel injectors and their nozzles are also decreased, particularly when utilizing traditional manufacturing processes such as casting and/or machining. By providing the fuel injector 64 and its fuel nozzle 80 of the present disclosure with relatively low, decreased fuel pressure drop requirements, the fuel system 58 may be configured with one or more additional fuel injectors 64 without requiring additional fuel pressure.

Figure 13:
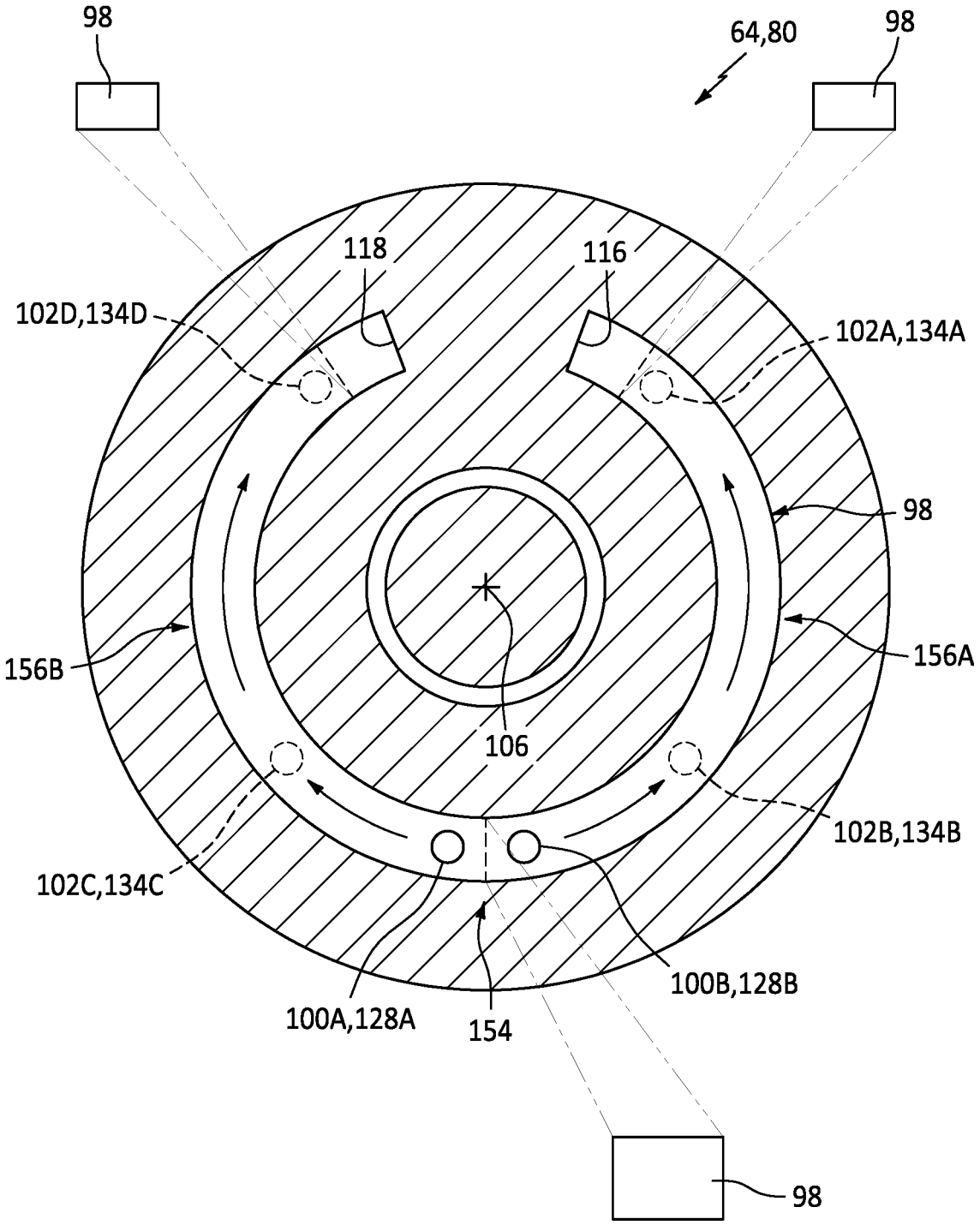
FIG. 13 is a cross-sectional illustration of a fuel nozzle configured with a double tapered fuel gallery.

Referring to FIG. 13, to further decrease pressure drop requirements, the fuel gallery 98 may be configured with a double tapered configuration. With such a configuration, the gallery first end 116 may be configured as a first downstream end of the fuel gallery 98 and the gallery second end 118 may be configured as a second downstream end of the fuel gallery 98. The exit passage orifices 134 may be generally arranged about the axis 106 as described above; however, the one or more feed passage orifices 128 may be arranged circumferentially intermediately between the gallery ends 116 and 118. The one or more feed passage orifices 128 of FIG. 13, for example, are located at (e.g., on, adjacent or proximate) an intermediate location 154 (e.g., a circumferential midpoint) circumferentially along the fuel gallery 98 between the gallery first end 116 and the gallery second end 118. The feed passage orifices 128 of FIG. 13, for example, are disposed on opposing circumferential sides of the intermediate location 154, and slightly circumferentially spaced from the intermediate location 154. The present disclosure, however, is not limited to such an exemplary feed passage orifice arrangement. For example, in other embodiments, the feed passage orifices 128 may be circumferentially aligned (but radially spaced) at the intermediate location 154. In addition, or alternatively, one of the feed passages 100 may be omitted such that the fuel nozzle 80 includes a single one of the feed passages 100 and a respective single one of the feed passage orifices 128.

The size of the fuel gallery 98 of FIG. 13 is configured to continuously (or intermittently) change as the fuel gallery 98 extends in a circumferential first direction (e.g., clockwise) from or about the intermediate location 154 to or about the gallery first end 116. The size of the fuel gallery 98 of FIG. 13 is also configured to continuously (or intermittently) change as the fuel gallery 98 extends in a circumferential second direction (e.g., counterclockwise) from or about the intermediate location 154 to or about the gallery second end 118, where the second direction is circumferentially opposite the first direction. The size of the first section 156A (e.g., first half) of the fuel gallery 98 and the size of the second section 156B (e.g., second half) of the fuel gallery 98 may change in uniform (the same) but opposite manners. The gallery second section 156B, for example, may be substantially a mirror image of the gallery first section 156A; however, the present disclosure is not limited to such a mirror image configuration. The size of each gallery section 156A, 156B (generally referred to as "156") may change, for example, as described above. For example, the axial length 122 (see FIGS. 7 and 8), the radial height 124 (see FIG. 9) and/or a geometry (e.g., shape) of each gallery section 156 may change (e.g., decrease) as that section 156 extends from or about the intermediate location 154 to or about the respective gallery end 116, 118.

A set of one or more of the exit passages 102 (e.g., 102A and 102B) and their orifices 134 (e.g., 134A and 134B) are arranged circumferentially between the intermediate location 154 (as well as the one or more feed passages 100) and the gallery first end 116. A set of one or more of the exit passages 102 (e.g., 102C and 102D) and their orifices 134 (e.g., 134C and 134D) are arranged circumferentially between the intermediate location 154 (as well as the one or more feed passages 100) and the gallery second end 118.

As similarly discussed above, the fuel gallery 98 of FIG. 13 is tailored to maintain an approximately uniform fuel velocity within the fuel gallery 98. In addition, by positioning the feed passage orifices 128 intermediately (e.g., midway or about midway) between the gallery first end 116 and the gallery second end 118, the fuel gallery 98 is configured to reduce a maximum (e.g., circumferential) distance the fuel travels through the fuel gallery 98, for example, by about half as compared to the fuel gallery 98 of FIG. 6. By reducing this distance of travel, the fuel gallery 98 of FIG. 13 may reduce the fuel flow pressure drop across the fuel gallery 98, for example, by about half. Thus, the fuel gallery 98 of FIG. 13 may further reduce fuel pressure requirements of the fuel nozzle 80.

Figure 14:
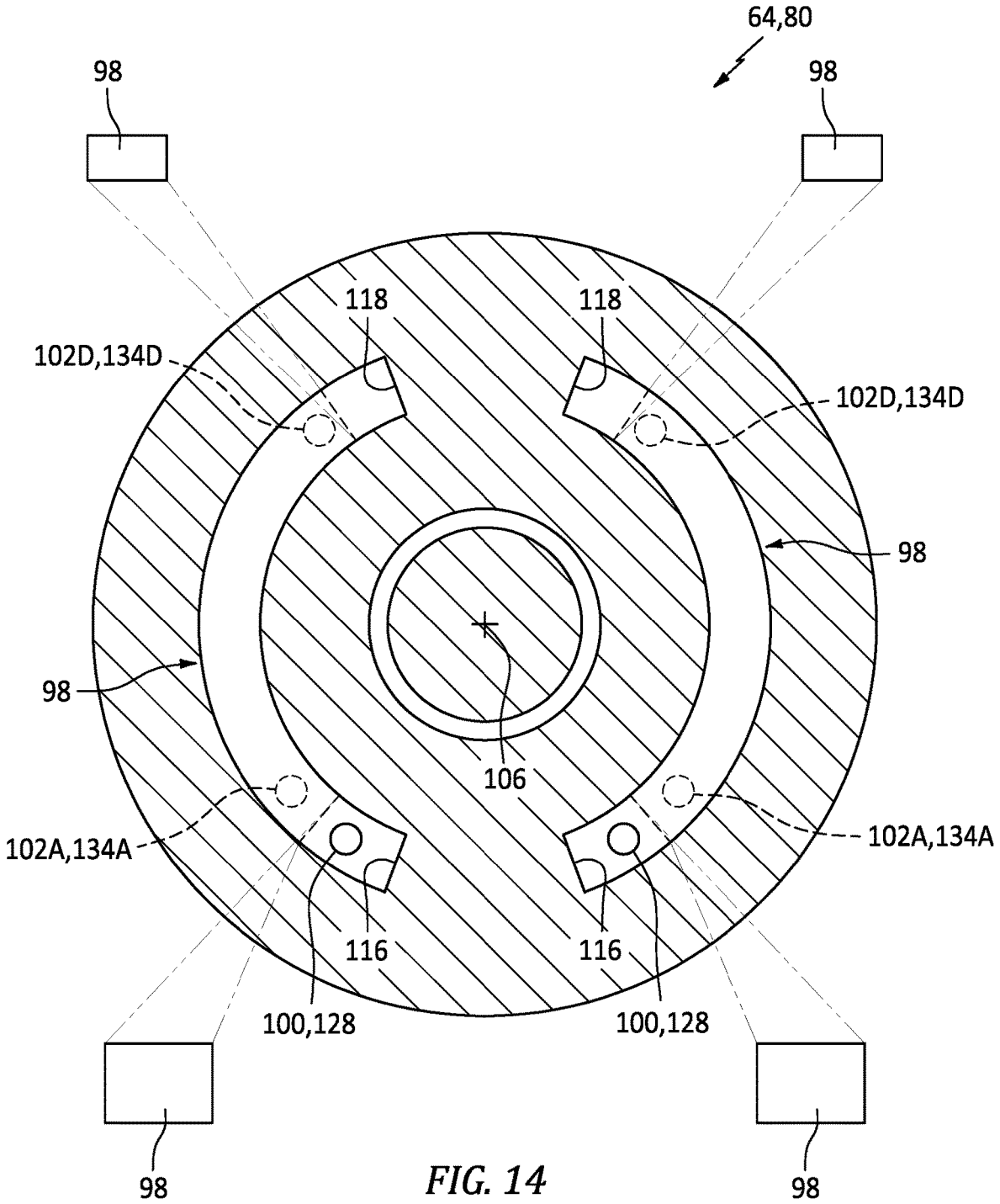
FIGS. 14 and 15 are cross-sectional illustration of fuel nozzles configured with multiple fuel galleries.
Figure 15:
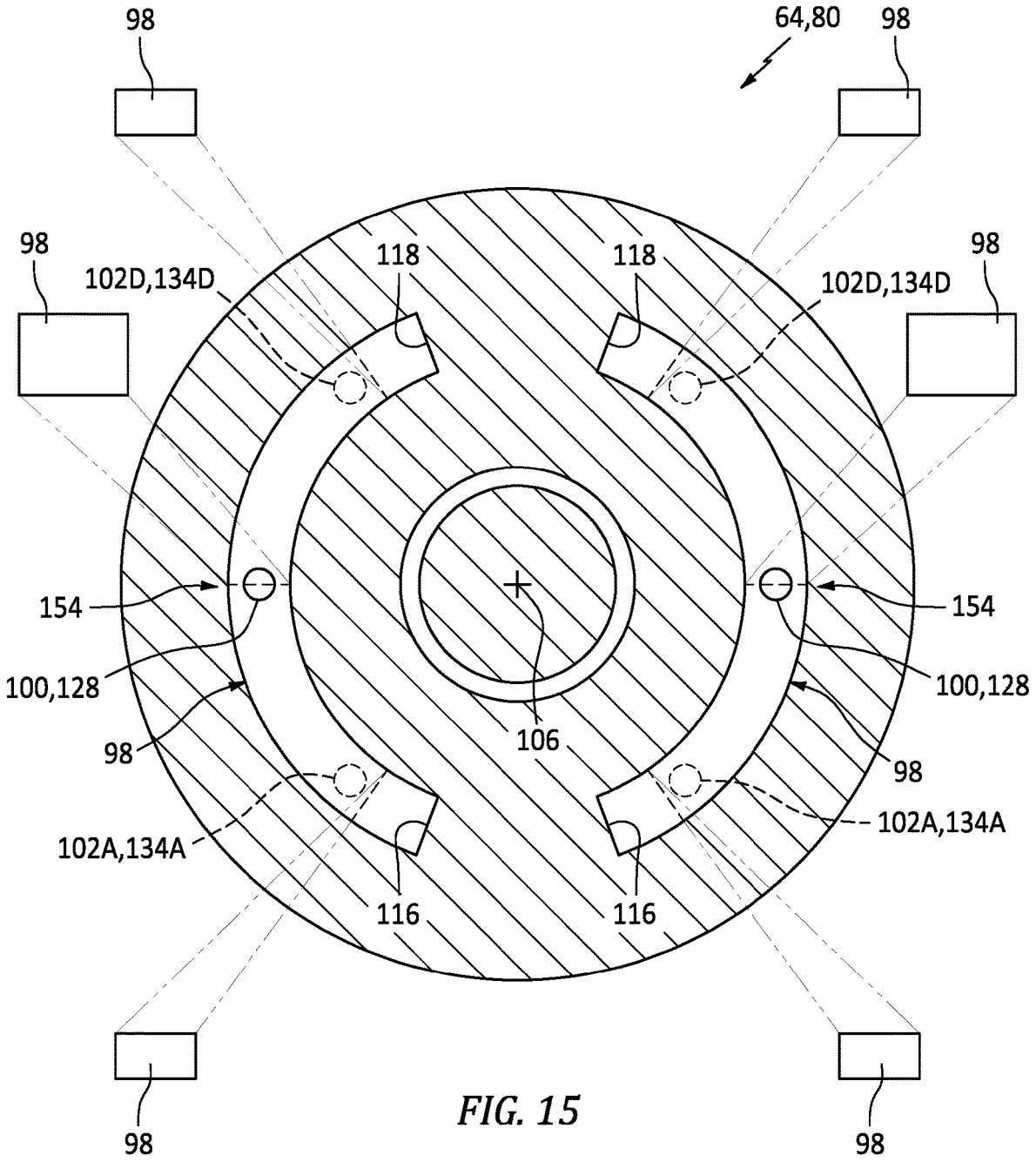

Referring to FIGS. 14 and 15, the fuel pressure requirements of the fuel nozzle 80 may be alternatively or further reduced by configuring the fuel nozzle 80 with more than one of the fuel galleries 98. For example, a single annular (or substantially annular) gallery may essentially be divided into two (or more) discrete arcuate fuel galleries 98. Each of these fuel galleries 98 may be generally configured as described above; however, each fuel gallery 98 may extend circumferentially within the fuel nozzle 80 less than one-hundred and eighty degrees (180°) around the axis 106 to its respective gallery ends 116 and 118. For example, each fuel gallery 98 may extend between one-hundred and thirty-five degrees (135°) and one-hundred and seventy-five degrees (175°). In another example, each fuel gallery 98 may extend between ninety degrees (90°) and one-hundred and thirty-five degrees (135°). In still another example, each fuel gallery 98 may extend between forty-five degrees (45°) and ninety degrees (90°). The present disclosure, of course, is not limited to the foregoing exemplary ranges.

In some embodiments, referring to FIG. 4, each fuel nozzle 80 may be configured with one or more air passages 158 and 160. Each air passage 158, 160 of FIG. 4 is configured to direct compressed air from the diffuser plenum 84 into the combustion chamber 54. Each air passage 158, 160 of FIG. 4 is further configured to promote mixing of the compressed air with the fuel injected into the combustion chamber 54.

In some embodiments, each fuel nozzle 80 may be configured with a supplemental fuel circuit 162. This supplemental fuel circuit 162 may include a central fuel exit passage 163 along the axis 106. The supplemental fuel circuit 162 may be configured as a pilot fuel circuit, which may receive and inject fuel during turbine engine startup. The supplemental fuel circuit 162 may also or alternatively receive and inject fuel during high power turbine engine operation; e.g., during aircraft takeoff or high thrust maneuvers. Of course, in other embodiments, one or more or each of the fuel nozzles 80 may be configured without any additional fuel circuits.

In some embodiments, each fuel nozzle 80 may be formed as a monolithic body.

Figure 16:
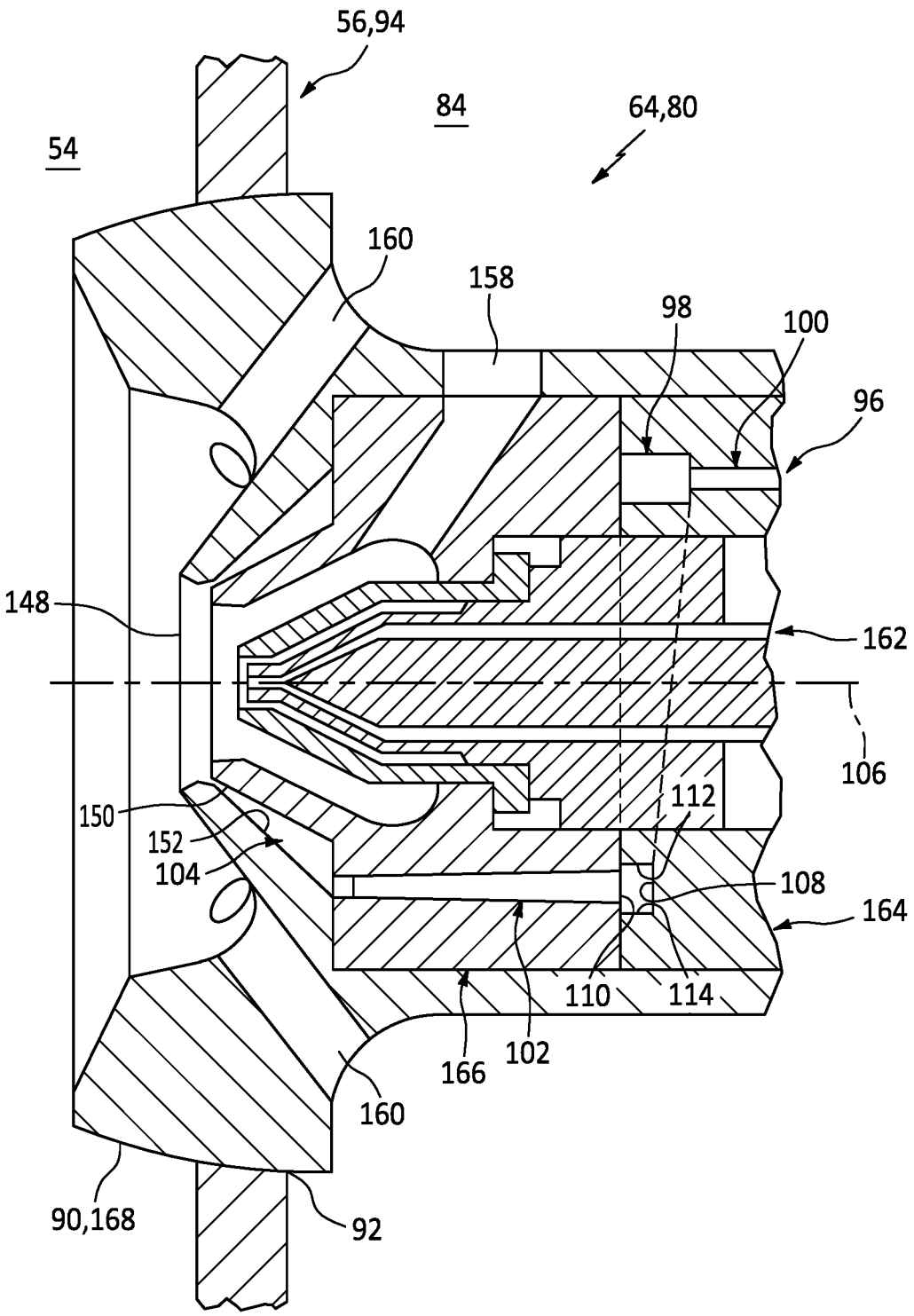
FIG. 16 is a side sectional illustration of a multi-segment fuel nozzle arranged with portion of the combustor wall.

At least the fuel nozzle 80 or the entire fuel injector 64, for example, may be additively manufactured, metal injection molded (MIM), cast, machined and/or otherwise formed as a single, unitary body; e.g., from a single mass of metal. Alternatively, each of the fuel nozzles 80 may be formed from a plurality of discretely formed components which are subsequently assembly together (e.g., via mechanical attachment, bonding, etc.) to provide the respective fuel nozzle 80. For example, referring to FIG. 16, the fuel nozzle 80 may include at least a fuel nozzle body 164, a fuel nozzle insert 166 and a fuel nozzle head body 168. At least these fuel nozzle components 164, 166 and 168 may collectively form the fuel nozzle circuit 96 within the fuel nozzle 80. For example, at least the fuel nozzle body 164 may form the feed passages 100. The fuel nozzle body 164 and the fuel nozzle insert 166 may collectively form the fuel gallery 98 axially therebetween. The fuel nozzle body 164, for example, may form the fuel gallery sidewalls (e.g., 108, 112 and 114). The fuel nozzle insert 166 may form the fuel gallery sidewall (e.g., 110). The fuel nozzle insert 166 may form the exit passages 102. The fuel nozzle insert 166 and the fuel nozzle head body 168 may collectively form the fuel film passage 104 therebetween. The fuel nozzle insert 166, for example, may form the film passage inner surface 150. The fuel nozzle head body 168 may form the film passage outer surface 152.

The present disclosure, however, is not limited to the foregoing exemplary segmented (e.g., non-monolithic) fuel nozzle configuration.

The combustor 56 is described above as an annular combustor. However, in other embodiments, the fuel system 58 may be configured to deliver fuel to one or more non-annular combustors; e.g., CAN-type combustors.

The fuel system 58 and/or one or more of its fuel injectors 64 may be included in various turbine engines other than the one described above. The fuel system 58, for example, may be included in a geared turbine engine where a gear train connects one or more shafts to one or more rotors in a fan section, a compressor section and/or any other engine section. Alternatively, the fuel system 58 may be included in a turbine engine configured without a gear train; e.g., a direct drive turbine engine. The fuel system 58 may be included in a geared or non-geared turbine engine configured with a single spool, with two spools (e.g., see FIG. 1), or with more than two spools. The turbine engine may be configured as a turbofan engine, a turbojet engine, a propfan engine, a pusher fan engine, an auxiliary power unit (APU) or any other type of turbine engine. The present disclosure therefore is not limited to any particular types or configurations of turbine engines. In addition, while the turbine engine is described above for use in an aircraft application, the present disclosure is not limited to such aircraft applications. For example, the turbine engine may alternatively be configured as an industrial gas turbine engine, for example, for a land based power plant.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. A fuel injector for a turbine engine, comprising:

a fuel nozzle comprising a gallery, a plurality of feed passages and a plurality of exit passages;

the gallery extending within the fuel nozzle circumferentially around an axis between a first end of the gallery and a second end of the gallery, a size of the gallery decreasing as the gallery extends circumferentially around the axis from the first end of the gallery to the second end of the gallery;

the plurality of feed passages extending within the fuel nozzle to the gallery, the plurality of feed passages configured to supply a fuel to the gallery, and the plurality of feed passages comprising a first feed passage that is fluidly coupled with the gallery at a first feed passage orifice;

the plurality of exit passages extending within the fuel nozzle from the gallery, the plurality of exit passages configured to receive the fuel from the gallery, and the plurality of exit passages comprising a first exit passage that is fluidly coupled with the gallery at a first exit passage orifice; and wherein the first exit passage orifice is circumferentially between the first feed passage orifice and the first end of the gallery.

2. The fuel injector of claim 1, wherein an axial height of the gallery decreases as the gallery extends circumferentially around the axis from the first end of the gallery to the second end of the gallery.

3. The fuel injector of claim 1, wherein a cross-sectional area of the gallery decreases as the gallery extends circumferentially around the axis from the first end of the gallery to the second end of the gallery.

4. The fuel injector of claim 1, wherein the plurality of feed passages are fluidly coupled to the gallery at the first end of the gallery.

5. The fuel injector of claim 1, wherein the gallery extends, more than two-hundred and seventy degrees and less than three-hundred and sixty degrees, circumferentially around the axis from the first end of the gallery to the second end of the gallery.

6. The fuel injector of claim 1, wherein the first exit passage extends along a centerline that is non-parallel with the axis.

7. The fuel injector of claim 1, wherein the plurality of feed passages further comprises a second feed passage;

the second feed passage is fluidly coupled with the gallery at a second feed passage orifice;

and the first exit passage orifice is circumferentially between the first feed passage orifice and the second feed passage orifice.

8. The fuel injector of claim 1, wherein a longitudinal centerline of the first exit passage is parallel with the axis.

9. The fuel injector of claim 1, wherein the first exit passage orifice is a first exit passage inlet orifice and the first exit passage extends within the fuel nozzle between the first exit passage inlet orifice and a first exit passage outlet orifice; and the first exit passage inlet orifice is circumferentially offset from the first exit passage outlet orifice.

* * * * *